US005586636A

United States Patent [19]

Linnig

[11] Patent Number: 5,586,636

[45] Date of Patent: Dec. 24, 1996

[54] FRICTION CLUTCH, PARTICULARLY FOR A FAN WHEEL OF A MOTOR VEHICLE ENGINE FAN

[76] Inventor: Karl-Heinz Linnig, Schillerstrasse 10, 88677 Markdorf, Germany

[21] Appl. No.: 274,688

[22] Filed: Jul. 14, 1994

[30] Foreign Application Priority Data

Jul. 15, 1993 [DE] Germany ..... 43 23 651.0

[51] Int. Cl.[6] ..... F16D 29/00

[52] U.S. Cl. ..... 192/48.2; 192/48.3; 192/85 A; 192/91 A; 192/84.3; 310/100; 310/105

[58] Field of Search ..... 192/48.2, 48.3, 192/84 PM, 85 A, 85 AA, 91 A; 310/105, 100; 464/29; 416/169 A

[56] References Cited

U.S. PATENT DOCUMENTS

| | | | |
|---|---|---|---|
| 2,983,350 | 5/1961 | Schultz | 192/84 PM |
| 3,458,122 | 7/1969 | Andriussi et al. | 310/105 X |
| 4,227,861 | 10/1980 | LaFlame | 192/48.3 X |
| 4,418,807 | 12/1983 | Raines | 192/85 AA X |

FOREIGN PATENT DOCUMENTS

| | | | |
|---|---|---|---|
| 0282741 | 9/1988 | European Pat. Off. . | |
| 0317703 | 5/1989 | European Pat. Off. . | |
| 0038448 | 10/1991 | European Pat. Off. . | |
| 0499698 | 8/1992 | European Pat. Off. . | |
| 2057281 | 5/1971 | France . | |
| 2207559 | 6/1974 | France . | |
| 2595299 | 9/1987 | France . | |
| 1020242 | 11/1957 | Germany | 192/48.2 |
| 1020243 | 11/1957 | Germany | 192/84 PM |
| 1096213 | 12/1960 | Germany | 192/84 PM |
| 1138983 | 10/1962 | Germany . | |
| 2056456 | 5/1972 | Germany . | |
| 2815474 | 10/1979 | Germany . | |
| 8109726 U | 7/1981 | Germany . | |
| 3137270 | 4/1983 | Germany . | |
| 3143434 | 5/1983 | Germany | 192/85 AA |
| 3203143 | 8/1983 | Germany . | |
| 3443523 | 6/1986 | Germany . | |
| 3828110 | 2/1990 | Germany | 310/105 |
| 4207709 | 9/1993 | Germany . | |
| 4207710 | 9/1993 | Germany . | |
| WO91/11594 | 8/1991 | WIPO . | |

*Primary Examiner*—Richard M. Lorence
*Attorney, Agent, or Firm*—Spencer & Frank

[57] ABSTRACT

A friction disc clutch is proposed, particularly for a fan wheel of a motor vehicle internal combustion engine or the like, in which a direct rotational speed transmission of the engine rotational speed takes place by means of a first friction disc clutch which can be actuated pneumatically or hydraulically, a reduced entrainment rotational speed of the fan wheel being transmitted via an eddy-current clutch when the friction disc clutch is disengaged.

12 Claims, 2 Drawing Sheets

FRICTION CLUTCH, PARTICULARLY FOR A FAN WHEEL OF A MOTOR VEHICLE ENGINE FAN

BACKGROUND OF THE INVENTION

The invention relates to a friction clutch, particularly for a fan wheel of a motor vehicle internal combustion engine or the like, that comprises a drive shaft connected to the internal combustion engine. The drive shaft is rotated at an engine rotational speed. A friction disc clutch operatively connects the drive shaft to the fan wheel. An eddy-current clutch entrains the fan wheel when the friction disc clutch is disengaged, so that the fan wheel is rotated at a speed less than the engine rotational speed.

PRIOR ART

A friction disc clutch for the fan wheel of a fan, particularly of motor vehicle internal combustion engines, is known from DE 32 03 143 C2 in which the fan wheel is entrained by a clutch appliance configured as an eddy-current clutch when the friction disc clutch is disengaged. In this, the drive shaft is connected to a rotor wheel and the freely rotating fan wheel is connected to a permanent magnet of the eddy-current clutch. The task and object of the known friction disc clutch is to continue movement of the fan wheel of the motor vehicle engine at a certain minimum entrainment speed by means of an eddy-current clutch even when the friction disc clutch is disengaged in order, for example, to ensure the cooling of electronic components located in the engine compartment. So that an increased cooling requirement can be met, the fan wheel in the known device can be driven at the direct rotational speed of the drive shaft, i.e. at the engine rotational speed, by means of an electromagnetically actuated friction disc clutch. Such a condition, however, is only necessary in the case of the highest demands of the engine. Otherwise, a reduced rotational speed of the fan, which is determined by the maximum entrainment rotational speed of the eddy-current clutch, can be set when the electromagnetic friction disc clutch is disengaged. This entrainment rotational speed is, for example, of the order of value of approximately 1100 rpm in the known arrangement. It is controlled by the number of permanent magnets and the distance between the rotor and the permanent magnets. The known device can, in consequence, generate two fan rotational speeds which are determined by the entrainment rotational speed of the eddy-current clutch and by the engine rotational speed itself.

A fan arrangement has become known from the even older registered design DE-U-81 09 726 in which no eddy-current clutch is employed for generating an entrainment rotational speed of the fan wheel so that, after an electromagnetic friction disc clutch is switched on, the fan wheel is driven with engine rotational speed. When the friction disc clutch is disengaged, however, the fan wheel can be entrained by means of the ball bearing friction of the fan wheel hub, which is supported in this way.

Finally, an electromagnetically actuated friction disc clutch arrangement for driving a fan wheel of a fan on a motor vehicle internal combustion engine is known from the applicant's EP 0 317 703 B1. In this, a first electromagnetic friction disc clutch, which again drives the fan wheel at a ratio of 1:1 relative to the engine rotational speed, is provided for producing the engine rotational speed. A lower entrainment rotational speed is generated by an eddy-current clutch which is switched on by a second electromagnetic friction disc clutch with the first electromagnetic friction disc clutch remaining disengaged. If both electromagnetic clutches are disengaged, the rotor of the eddy-current clutch is nevertheless moved by means of the drive shaft and the ball bearing friction so that the entrainment rotational speed is set to a level which is still further reduced.

The use of electromagnetically actuated friction disc clutches for the fan drive has, in consequence, become known in various embodiments. Such friction disc clutches work in a purely frictional manner so that, in contrast to positive clutches, the engagement force must act as long as the clutch has to transmit power. In consequence, magnetic attractive force is mainly used as the engagement force and therefore as the clutch force. In particular applications, however, this can be disadvantageous because additional electrical transmission measures with corresponding support of the stator are necessary for the electromagnetic clutch.

SUMMARY OF THE INVENTION

In contrast to these known appliances, an alternative embodiment has been found, in accordance with the present invention, which dispenses, in particular, with the employment of electromagnetically acting friction disc clutches. The advantages of the most flexible possible applicability of the friction disc clutch for a fan drive are maintained, the criteria indicated at the beginning being the important ones. Reference is expressly made herewith to the corresponding statements in the publications quoted.

The friction disc clutch for the drive of a fan wheel according to the invention develops its full advantages in large omnibus engines or truck engines which are configured as turbocharged engines. The supercharged air of a turbocharger must, as a general rule, be cooled at the radiator of the motor vehicle in order to bring it to an optimum working temperature. Furthermore, such vehicles operate with a so-called retarder brake which effects braking of the vehicle by means of an oil circuit, of a so-called Vöttinger clutch. In this, the energy arising during braking is converted to the motion of an oil flow and the oil can, in turn, be strongly heated. This oil must also be cooled in an oil cooler by means of the fan system. Finally, the radiator of the internal combustion engine must also be cooled and this takes place by means of the fan wheel drive of the fan.

The above statements show that the cooling system in such engines operates in a very sensitive manner and is subjected to high demands. If the cooling of the individual units is not designed in an optimum fashion, the engine operates with a worse efficiency and this also affects, in particular, the fuel consumption and the exhaust gas pollution. It is necessary to ensure that the internal combustion engine does not run undercooled either because poor combustion of the fuel is also associated with this.

A highly sensitive friction clutch, which can be set in an adjustable manner to the individual operating conditions, is necessary to meet these requirements. Weight is to be avoided as far as possible and existing units should continue to be employed in the motor vehicle.

In consequence, the friction clutch according to the invention is to be integrated into such a system of units and the compressed air circuit, which is available in any case for compressed-air brakes of the motor vehicle, or even an oil circuit are also to be employed in such a way that corresponding engagement and disengagement of the friction clutch can take place by this means. In consequence, the invention provides, for example, for a compressed-air actuated piston/cylinder device to actuate a friction disc clutch or put it out of action, which friction disc clutch is to subject the fan wheel to the engine rotational speed directly. When the friction disc clutch is open, an additionally present eddy-current clutch is to effect, in a manner known per se, the necessary lower entrainment rotational speed of the fan wheel. It is then generally sufficient for the eddy-current clutch to be directly connected to the drive shaft of the friction clutch so that the fan wheel is driven with at least the associated entrainment speed. A further intermediate clutch which only puts the eddy-current clutch into use when required can, of course, be included in this case also.

The actuation of the friction disc clutch by means of a pneumatically or hydraulically acting piston/cylinder arrangement is to take place, as alternatives, in such a way that when appropriately subjected to pressure, the friction disc clutch is either opened or closed. The first effects a safety device because in the absence of pressure, the friction disc clutch is closed and, therefore, the fan wheel is driven at engine rotational speed, i.e. at maximum rotational speed. In consequence, should the pneumatic or hydraulic system fail, the fan wheel will operate at maximum rotational speed. On the other hand, the pneumatic or hydraulic piston/cylinder drive for the friction disc clutch can be connected in such a way that the latter is only activated when the piston/cylinder device is subjected to pressure so that it is only in this case that full rotational speed drive of the fan wheel takes place.

Further details and advantages of the invention follow from the drawings and can be extracted from the following explanation of embodiment examples.

In these

DESCRIPTION OF THE INVENTION

Figure 1:
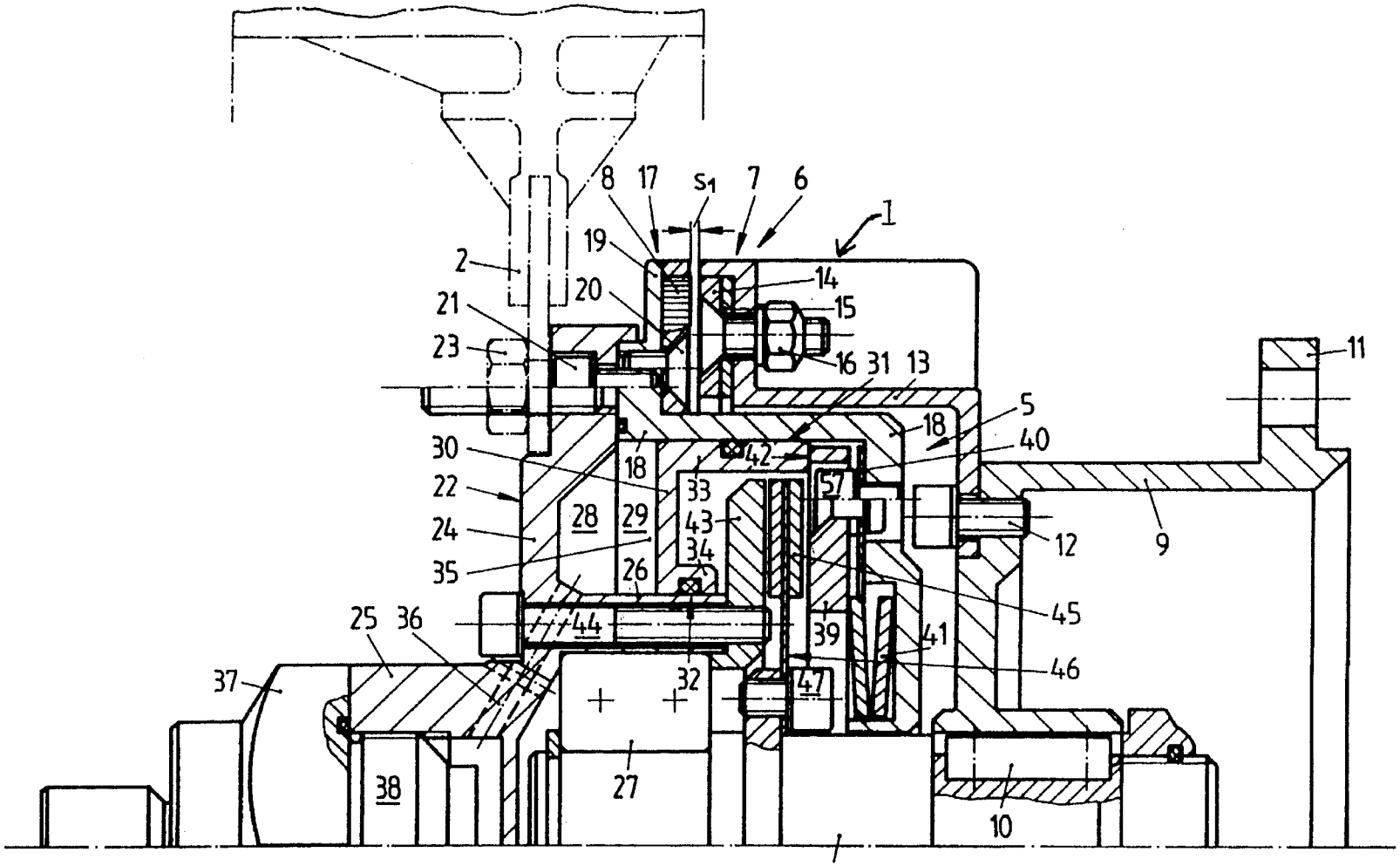
FIG. 1 shows a first embodiment example of a friction clutch with engagement of the friction disc clutch when the piston/cylinder unit is relieved of pressure and FIG. 2 shows an alternative embodiment with engagement of the friction disc clutch when the piston/cylinder unit is subjected to pressure.

The friction clutch 1 represented in FIG. 1 is used for driving a fan wheel 2 and is therefore used as the cooling unit, particularly for a motor vehicle internal combustion engine. The friction clutch represented is configured as a so-called two-stage clutch such as is also described in the applicant's DE 32 03 143 C2. Reference is herewith made expressly to the contents of the latter publication. A first friction disc clutch 5, which can be actuated pneumatically or hydraulically, is provided for the direct coupling of the rotating fan wheel 2 to a drive shaft 4 for matching the rotational speeds thereof. If this first friction disc clutch is engaged, there is a frictional connection at a ratio of 1:1 between the drive shaft 4 and the fan wheel 2 to be driven.

If this first friction disc clutch 5 is disengaged, the fan wheel 2 is nevertheless driven at a reduced entrainment rotational speed by means of the continuing presence of the eddy-current clutch 6, the entrainment rotational speed depending on the distance $s_1$ between the rotor wheel 7 and the permanent magnets 8. Depending on the application, this distance is selected at between 0.5 and 4 mm, entrainment rotational speeds are set of the order of value, for example, of up to approximately 1100 rpm. The number of permanent magnets also determines the magnitude of the entrainment rotational speed.

In the embodiment example of FIG. 1, the drive shaft 4 of the friction clutch 1 is driven by means of a cup-shaped housing 9, a key 10 forming a positive connection with the drive shaft 4 and a connecting flange 11 forming the connection to the crankshaft of a motor vehicle internal combustion engine (not represented in any more detail). A housing 13 of Z-shaped cross-section is in turn screwed onto this housing 9 by means of a screw connection 12, which housing 13 is used for accommodating the rotor wheel 7 of the eddy-current clutch 6. By means of this arrangement, the friction disc clutch 5 is surrounded in an annular manner by the eddy-current clutch 6. The rotor wheel of the eddy-current clutch 6 consists of an end-surface copper plate 14 with a steel plate 15 behind it, which are connected to the annular rotor wheel 7 by means of a screw connection 16.

Opposite to the rotor wheel 7 of the eddy-current clutch 6, with a gap $s_1$, there is a magnet plate wheel 17 in which the permanent magnets 8 are embedded on the periphery of the annular plate. The number of magnets is determined from the particular application and determines the magnitude of the entrainment rotational speed.

The magnet plate wheel 17 is connected to a clutch housing 18 which is again of Z-shaped or cup-shaped cross-section and is used to accommodate the first friction disc clutch 5. The radial fastening flange 19 of the cup-shaped clutch housing 18 is connected to the magnet plate wheel 17 by means of a screw connection 20. A further screw connection 21 connects this radial fastening flange 19 of the cup-shaped clutch housing 18 by means of a screw connection 23 to a fastening housing 22, flanged on at the end, for the fan wheel 2. This fan wheel fastening housing 22 is configured approximately L-shaped in cross-section with a radial wall section 24 and an axial, cup-shaped wall section 25 which extends forward at the end. The fan wheel fastening housing 22 has, furthermore, a housing section 26 extending axially and pointing in the direction of the internal combustion engine, as is shown in FIG. 1. This housing section 26 has a plurality of functions. The fastening housing 22 is rotatably supported on the drive shaft 4 by means of the axial housing section 26 and a double ball bearing 27. At the same time, the radial wall section 24 forms, together with the axial housing section 26, an annular recess 28 which is connected to a cylinder space 29 for accommodating a pneumatic piston 30. The annular pneumatic piston 30 of the friction disc clutch 5 is supported in the cup-shaped housing 18 by means of its cylindrical outer surface 31. The inner support surface 32 of the annular piston 30 is supported on the axial housing surface of the housing section 26. The annular piston 30 is configured U-shaped in cross-section, the radially outer arm 33 having approximately twice the length of the radially inner arm 34. The radial end 35 of the piston 30 is acted on by compressed air which is supplied to the fastening housing 22 via a compressed air supply hole 36. For this purpose, the axial and cup-shaped wall section 25 of the fastening housing 22 is provided with a rotary joint 37 for the air supply to the internal space 38 of the wall section 25.

The friction disc clutch 5 is configured as a pneumatically actuated clutch. For this purpose, an axially displaceable anchor plate 39 is located in and fastened to the housing 18 with no rotational clearance by means of an annular spring plate 40. The annular spring plate 40 has, on its surface, a plurality of fastening holes which are alternatively used for fastening the adjacent components. The screw connection 57 is used for this purpose. A spring pack 41 presses the radially outer region of the anchor plate 39 against the radial end surface 42 of the axially extending outer arm 33 of the pressure piston 30.

Arranged opposite the anchor plate 39 is a counterplate 43, which is connected to the fastening housing 22 by means of a screw connection 44. In this arrangement, the axially extending housing section 26 of the fastening housing 22 likewise serves as a spacer and as a housing section for the accommodation of the pressure piston 30.

A friction disc lining 45, which like the anchor plate 39 is connected to the drive shaft 4 via a flexible, axially displaceable plate 46 by means of the screw connection 47, is arranged between the counterplate 43 and the anchor plate 39.

The friction clutch shown in FIG. 1 operates as follows:

If the pressure space 28, 29 located in front of the piston surface 35 is subjected to pressure medium, for example compressed air, via the conduit 36, the piston 30 is moved axially to the right (in FIG. 1) in the clutch housing 18 and in the housing section 26 and its radially outer arm 33 presses on the anchor plate 39 against the force of the spring pack 41. The flexible annular spring plate 40 permits the axial motion. This releases the frictional connection of the friction disc clutch 5 so that the friction disc lining 45 can freely rotate on the drive shaft 4 between the anchor plate 39 and the counterplate 43. In this case, only the eddy-current clutch 6 is effective and this transmits the engine rotational speed of the motor vehicle engine via the connecting flange 11 to the cup-shaped housing 9 and from there to the Z-shaped housing 13. The eddy-current clutch 6 flanged onto the housing 13 effects a reduced rotational speed transmission to the radial fastening flange 19 of the coupling housing 18 and from there to the fastening housing 22 on which the fan wheel 2 is fastened. Despite high engine rotational speed, the fan blade of the fan 3 is, in consequence, driven at a reduced entrainment rotational speed.

If a direct rotational speed transmission of the engine rotational speed to the fan wheel 2 is desired, the pressure piston 30 is relieved of pressure medium at its end surface 35 so that it does not exert any pressure effects on the anchor plate 39. In this case, the spring pack 41 presses the anchor plate 39 against the friction plate lining 45 and the latter against the counterplate 43 so that there is a frictional connection between the drive shaft 4, which rotates with engine rotational speed, and the clutch pack consisting of the anchor plate 39 with annular spring plate 40, friction plate lining 45 and counterplate 43. This torque is transmitted to the fan wheel 2 and therefore to the fan 3 by means of the firm connection of the anchor plate 39 to the coupling housing 18 and to the fastening housing 22, on the one hand, and from the counterplate 43 by means of the screw connection 44 to the fastening housing 22, on the other hand.

The arrangement selected in accordance with FIG. 1 has the advantage that if the compressed air supply in the system fails, the higher fan rotational speed occurs due to the forced engagement of the friction disc clutch 5. In case of doubt, therefore, the higher cooling effect of the fan is effective with this engagement arrangement.

Figure 2:
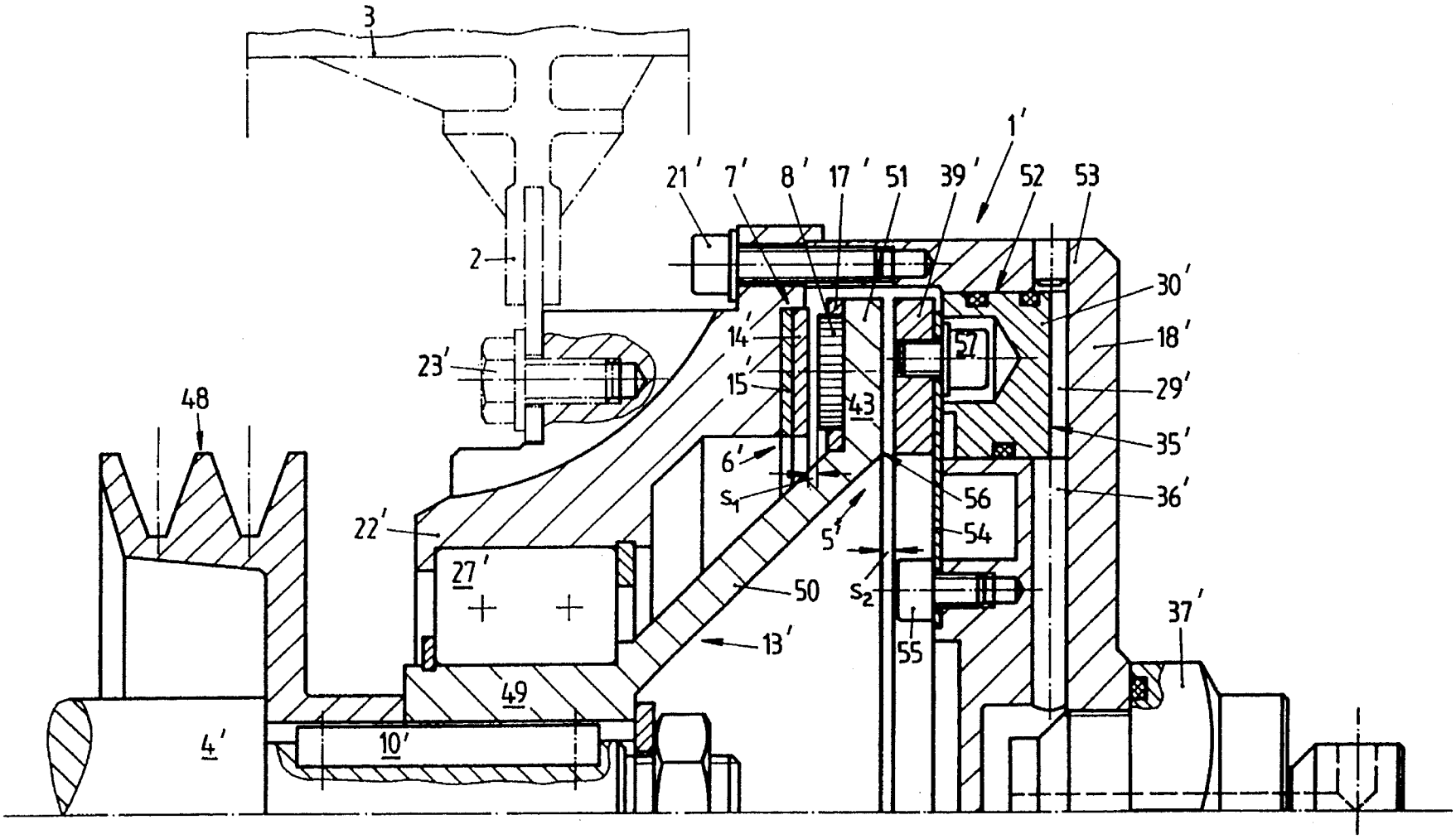

A different engagement arrangement of the friction disc clutch 5 is selected in the embodiment example of FIG. 2. Otherwise, the same or corresponding parts are designated with the same reference signs as in FIG. 1.

The drive from the motor vehicle engine, not shown in any more detail, takes place by means of a belt pulley 48 on the drive shaft 4' of the friction clutch 1'. A direct connection between the drive shaft 4' to the crankshaft of the drive engine can also, of course, exist in this case. The drive shaft 4' is positively connected to the (drive) housing 13' for the eddy-current clutch 6' by means of the key 10'. This accommodation housing has an axial wall section 49, a wall section 50 widening in funnel-shape and a radially extending wall section 51. On its left-hand end, the radial wall section 51 carries the magnet plate wheel 17' for accommodating the permanent magnets 8' of the eddy-current clutch 6'. The rotor wheel 7' of the eddy-current clutch, consisting of the copper plate 14' and the steel plate 15', is located opposite with a gap $s_1$.

The rotor wheel 7' of the eddy-current clutch 6' is embedded in the end of the fan wheel fastening housing 22' and is firmly connected to the latter. The fan wheel 2 is fastened to the fastening housing 22' by means of a screw connection 23'. The rotor wheel fastening housing 22' is supported on the drive shaft 4' by means of the ball bearing 27' so that it can rotate freely, the ball bearing 27' being arranged on the axial wall section 49 of the housing 13'.

The clutch housing 18' for accommodating the piston 30' of the friction disc clutch 5' has an annular peripheral cylinder space 52 in which the annular piston 30' is supported so that it can be displaced axially. The cylinder space 29' located behind the piston 30' is used for subjecting the end piston surface 35' to pressure by means of a pneumatic or hydraulic pressure medium which is supplied, via a radially extending supply hole 36', to the cylinder space 29'. A rotary joint 37' is again used for supplying the pressure medium to the cylinder space 29'.

The radially outer axial wall section 53 of the clutch housing 18' is connected so that it is rotationally fixed to the fan wheel fastening housing 22' by means of the screw connection 21'.

The friction disc clutch 5' is formed by the anchor plate 39' which is in turn fastened so that it can be axially displaced on the clutch housing 18' by means of a spring plate 54 and a screw connection 55, 57. The anchor plate 39' and the piston 30' form an axially displaceable constructional unit which is held by the annular spring plate 54. The anchor plate 39' interacts with the rear surface 56 of the radial wall section 51 of the housing 13', which is opposite to the anchor plate 39' with a gap $s_2$. The rear end surface 56 and the anchor plate 39' are configured as friction disc linings. The piston 30' presses the anchor plate 39' against the rear end surface 56 of the wall section 51, thus closing the gap $s_2$, when the cylinder space 29' is subjected to pressure.

The friction clutch shown in FIG. 2 therefore operates as follows:

If the pressure space 29' of the cylinder space 52 is not subjected to pressure medium, the friction disc clutch 5' is inactive. In this case, the engine rotational speed transmitted to the drive shaft 4' via the belt pulley 48 is transmitted via the key 10' to the housing 13' and, therefore, to the eddy-current clutch 6'. The eddy-current clutch 6' in turn transmits a reduced rotational speed to the fan wheel fastening housing 22' and therefore to the fan wheel 2. The magnitude of the entrainment rotational speed is determined by the construction of the eddy-current clutch 6'.

Direct rotational speed transmission from the belt pulley 48 to the fan wheel 2 takes place by actuating the friction disc clutch 5'. For this purpose, the pressure space 29' is acted upon by a pressure medium, in particular by compressed air, so that the piston 30' presses the anchor plate 39' against the rear surface 56 of the radial wall section 51 of the housing 13', thus closing the gap $s_2$. In this case, the force path takes place from the drive shaft 4' via the housing 13' to the anchor plate 39' and from there via the annular spring plate 54 to the clutch housing 18'. The torque is further transmitted via the radially outer, axial wall section 53 and the screw connection 21' to the fan wheel fastening housing 22' and, therefore, to the fan wheel 2.

The embodiment of FIG. 2 therefore contains compressed-air engagement which effects a direct coupling of the engine rotational speed to the fan wheel when the compressed air is effective.

The invention is not limited to the embodiment examples presented and described. In fact, it also includes all the specialist further developments and modifications within the framework of the idea according to the invention.

I claim:

1. A clutch assembly for a fan wheel of an internal combustion engine, comprising:

a drive shaft having an end connectable to the internal combustion engine and being axially rotatable at an engine rotational speed;

a friction disc clutch having a first portion connected to said drive shaft to rotate therewith, and a second portion adjacent to the first portion and connectable to the fan wheel, said friction disc clutch further comprising piston-and-cylinder means for engaging the first portion with the second portion to directly connect the fan wheel to said drive shaft so that the fan wheel is directly driven by said drive shaft and rotated at the engine rotational speed;

a rotary joint in fluid communication with said piston-and-cylinder means, and subjecting said piston-and-cylinder means to a fluid pressurized medium for the actuation and deactuation of said friction disc clutch; and an eddy-current clutch having a first portion connected to said drive shaft to rotate therewith, and a second portion adjacent to the first portion of said eddy-current clutch and connectable to the fan wheel, said eddy-current clutch entraining the fan wheel when said friction disc clutch is disengaged, so that the fan wheel is rotated at a speed less than the engine rotational speed.

2. The clutch assembly defined in claim 1, further comprising:

a drive housing encompassing said eddy-current clutch and directly connecting an input side of said eddy-current clutch to said drive shaft;

a fan wheel fastening housing fastened to an output side of said eddy-current clutch and to said fan wheel; and bearing means in engagement with said fan wheel fastening housing for allowing a rotation of said fan wheel fastening housing at a speed independent of a rotational speed of said drive shaft.

3. The clutch assembly defined in claim 1, further comprising:

a fan wheel fastening housing fastened to an output side of said eddy-current clutch and to said fan wheel;

an accommodation housing defining a cylinder space, accommodating said friction disc clutch, and being directly connected to said fan wheel fastening housing; wherein said friction disc clutch comprises friction means for directly connecting and decoupling said drive shaft and said fan wheel, and wherein said piston-and-cylinder means comprises a drive piston positioned within the cylinder space and being axially-displaceable for the actuation and deactivation of said friction disc clutch by subjecting said friction means to pressure and by relieving said friction means of pressure to directly connect and decouple said drive shaft and said fan wheel.

4. The clutch assembly defined in claim 3, further comprising an axially displaceable anchor plate connected to said accommodation housing, and a flexible annular spring plate exerting a spring force against said anchor plate for the axial displacement thereof; wherein said friction means comprises a friction disc lining interacting with said anchor plate when said friction disc clutch is actuated.

5. The clutch assembly defined in claim 1, further comprising:

a fan wheel fastening housing fastened to an output side of said eddy-current clutch and to said fan wheel;

an accommodation housing accommodating said friction disc clutch and being directly connected to said fan wheel fastening housing;

a counterplate firmly connected to said fan wheel fastening housing; and an axially displaceable anchor plate connected to said accommodation housing; wherein said friction disc clutch comprises an axially displaceable flexible clutch plate connected to said drive shaft, and a friction disc lining attached to two opposite sides of said clutch plate, and wherein said piston-and-cylinder means comprises a drive piston axially-displaceable by the pressurized medium; whereby said clutch plate is frictionally clamped between said anchor plate and said counterplate when said drive piston is not subjected to a pressure due to the pressurized medium.

6. The clutch assembly defined in claim 5, further comprising a plate spring axially for pressing said anchor plate against said friction disc lining.

7. The clutch assembly defined in claim 1, wherein said piston-and-cylinder means comprises a drive piston axially-displaceable by the pressurized medium; whereby said friction disc clutch is engaged so that the fan wheel is directly driven by said drive shaft when said drive piston is subjected to a pressure due to the pressurized medium.

8. The clutch assembly defined in claim 1, further comprising:

a drive housing encompassing said eddy-current clutch and having a first end region connected to said drive shaft, and a second end region directly connected to an input side of said eddy-current clutch, said second region further forming a counterplate;

an accommodation housing accommodating said friction disc clutch; and an axially displaceable anchor plate connected to said accommodation housing; wherein said piston-and-cylinder means comprises a drive piston axially-displaceable for the actuation and deactivation of said friction disc clutch; whereby said counterplate interacts with said anchor plate when said drive piston is subjected to a force.

9. The clutch assembly defined in claim 8, further comprising a flexible annular spring plate supporting said anchor plate and allowing for the axial displacement of said anchor plate within said accommodation housing.

10. The clutch assembly defined in claim 9, wherein said anchor plate and said drive piston form a constructional, axially displaceable unit enclosing said flexible annular spring plate therein.

11. The clutch assembly defined in claim 1, further comprising an accommodation housing defining a cylinder space, and accommodating said friction disc clutch; wherein said rotary joint and the cylinder space are in fluid communication with one another for the passage of the pressurized medium, and wherein said piston-and-cylinder means comprises a drive piston located within said cylinder space and axially-displaceable from pressure due to the pressurized medium, for the actuation and deactivation of said friction disc clutch.

12. A clutch assembly for a fan wheel of an internal combustion engine, comprising:

a friction disc clutch and an eddy-current clutch, each being arranged in parallel to each other, and each being locatable between the engine and fan wheel and connectable thereto for transmitting a force from the engine to the fan wheel;

said eddy-current clutch having a first portion connectable to a drive shaft to rotate therewith, and a second portion adjacent to the first portion of said eddy-current clutch and connectable to the fan wheel, said first and second portions being axially spaced from one another by a preselected distance, said distance remaining constant regardless of whether said friction disc clutch is engaged or disengaged;

means for engaging said friction disc clutch using a fluid pressurized medium so that the fan wheel is directly connected to the engine and is rotated at an engine rotational speed; and means for disengaging said friction disc clutch using the fluid pressurized medium so that said eddy-current clutch entrains the fan wheel and rotates the fan wheel at a speed less than the engine rotational speed.

* * * * *